United States Patent [19]

Yang et al.

[11] Patent Number: 4,575,268

[45] Date of Patent: Mar. 11, 1986

[54] DOT MATRIX PRINTER HEAD

[75] Inventors: Wu-ji Yang, Hsien; Kuo-Chyuan Chen, Taiwan, both of Taiwan

[73] Assignee: Industrial Technology Research Institute, Taiwan

[21] Appl. No.: 664,519

[22] Filed: Oct. 25, 1984

[51] Int. Cl.[4] ..... B41J 3/12

[52] U.S. Cl. ..... 400/124; 101/93.05

[58] Field of Search ..... 400/124; 101/93.05; 335/275, 276

[56] References Cited

U.S. PATENT DOCUMENTS

| | | | |
|---|---|---|---|
| 4,222,674 | 9/1980 | Mori | 400/124 |
| 4,225,250 | 9/1980 | Wagner | 400/124 |
| 4,230,412 | 10/1980 | Hebert | 400/124 |
| 4,348,120 | 9/1982 | Isobe | 400/124 |
| 4,368,353 | 1/1983 | Ando | 400/124 X |
| 4,389,127 | 6/1983 | Bellinger | 400/124 |
| 4,389,128 | 6/1983 | Asano | 400/124 |
| 4,444,519 | 4/1984 | Howell et al. | 400/124 X |

FOREIGN PATENT DOCUMENTS

| | | | |
|---|---|---|---|
| 148178 | 11/1980 | Japan | 400/124 |
| 27365 | 3/1981 | Japan | 400/124 |

*Primary Examiner*—Paul T. Sewell

*Attorney, Agent, or Firm*—Cahill, Sutton & Thomas

[57] ABSTRACT

A dot matrix printer head in which movement of a plurality of printing wires is effected by an equal member of circumferentially spaced armatures and the head employs permanent magnet and electromagnetic members for controlling movement of the individual armatures. An annular core base in the head has a plurality of cores of the electromagnetic members disposed in annular array thereon and an annular yoke member having the permanent magnet associated therewith is disposed on said base within said array of cores. Each of the armatures is associated with said yoke and one of said cores so that the permanent magnet provides a magnetic flux tending to move the armatures and printing wire to a non-print position. Each of the cores has a coil thereon which, when energized, neutralizes the flux from said permanent magnet for its core and the armature associated therewith. Spring members associated with each of the armatures bias the armatures and their respective wires toward the print position whereby the individual printing wires are caused to move to their print positions when the electromagnet coils associated therewith are energized. The armatures are positioned at the extremities of the yoke and the cores on one face of the core plate and the printing wires extend from the armatures through a central opening in the plate and out the opposite face of the plate. The extremity of the annular yoke preferably serves as a fulcrum for each of the armatures. Various arrangements for the spring members are employed.

6 Claims, 9 Drawing Figures

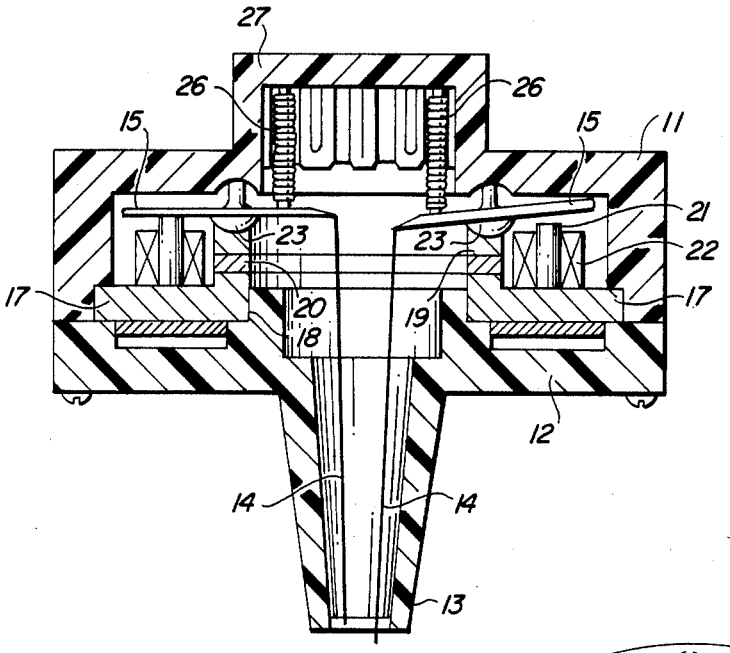
FIG. 4
FIG. 5
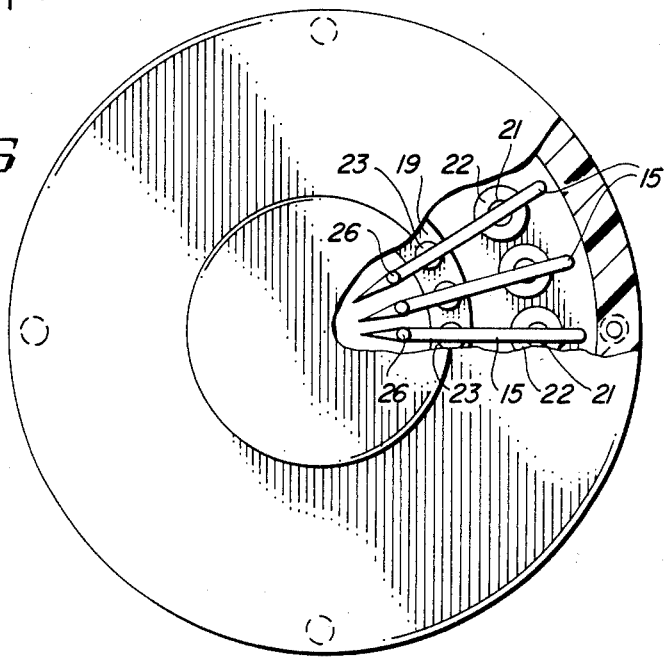
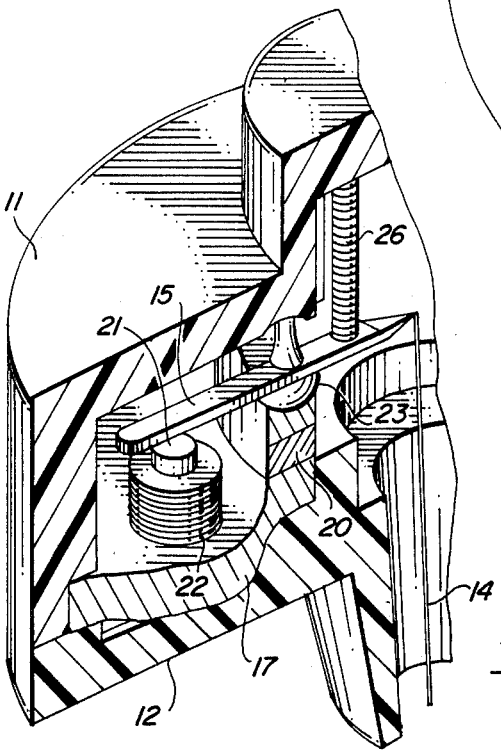
FIG. 6

DOT MATRIX PRINTER HEAD

TECHNICAL FIELD

This invention relates to high speed typewriting machines employing electromagnetically actuated wires for forming characters from a matrix of dots.

BACKGROUND ART

In order to print the large quantities of information issuing from modern computer systems it has been necessary to develop typewriting machines capable of operating at extraordinarily high speeds. One of the most successful types of such machines is the dot matrix printer in which a printing head contains a plurality of electrically actuated wires capable of producing a matrix of dots to form the characters. A significant advantage of this type of machine is that a single printing head can be used to print an endless number of letters and characters in a variety of languages such as, for example, English and Chinese.

U.S. Pat. No. 4,389,128, granted June 21, 1983 to K. Asano et al for "Print Head for a Dot Matrix Printer" discloses what can be termed a state-of-the-art printer head of the type with which the present invention is concerned. The Asano et al print head has a plurality of radially arranged wire actuating armatures which are maintained in a non-print position by a magnetic structure including an annular permanent magnet. The individual armatures are spring biased to move to their print positions when individual electromagnets associated with the magnetic structure are energized to cancel out the flux from the permanent magnet acting on the armatures. The electromagnets are arranged in a circular array within the annular permanent magnet. With this arrangement, when the overall size, i.e. diameter, of the head is held to a minumum the electromagnets are disposed in a cramped space with the result that the electromagnet coils are difficult to manufacture and heat dissipation from the coils is a difficult problem as is explained in the Asano et al patent. If the print head is made larger to overcome the space and heat problems an excessively large permanent magnet must be used. Moreover, for very high speed printing the size and weight of the printer head must be reduced to the absolute minimum, so making the head larger is counterproductive.

A somewhat simpler printer head is disclosed in U.S. Pat. No. 4,348,120, granted Sept. 7, 1982 to M. Isobe et al for "Printing Head for a Dot Printer". The arrangement of components there disclosed is essentially the same as in the printer head of the Asano et al patent so the Isobe et al printer head possesses the same shortcomings.

Other arrangements for the components of a printer head are disclosed in the following U.S. Pat. Nos.:

4,222,674, granted Sept. 16, 1980 to M. Mori et al for "Head Portion of a Dot Printer";

4,225,250, granted Sept. 30, 1980 to R. E. Wagner et al for "Segmented-Ring Magnet Print Head"; and 4,230,412, granted Oct. 28, 1980 to D. G. Herbert for "Matrix Print Head Assembly".

Notwithstanding the efforts of these prior inventors and others there continues to be a need for a compact, light weight, reliable printer head which can be manufactured inexpensively.

DISCLOSURE OF THE INVENTION

This invention contemplates positioning the electomagnets in an annular array outside an annular permanennt magnet or, stated differently, the permanent magnet structure is of small annular size to fit inside the electromagnet array. This arrangement positions the electromagnets adjacent the outer periphery of the head where, for even a head of small outside diameter, there is maximum space for the electromagnetic coils so that they may be easily formed and assembled so that heat is more easily dissipated therefrom and from the head to the surrounding atmosphere. The resulting smaller permanent magnet is less expensive because less material is required for its manufacture.

Among other features of this invention is the concept of utilizing an annular pole structure associated with the permanent magnet as a fulcrum for the wire actuating armatures. Depending upon the position of this fulcrum in relation to the inner and outer ends of the armatures the degree of leverage imparted to the armatures and hence the amount of force transmitted to the printing wire can be adjusted.

Various spring arrangements for biasing the armatures toward print position are contemplated by means of which further reductions in overall dimensions of the printer head can be achieved.

Lastly, the invention comtemplates that printing wires which are actuated by the armatures will extend through the central region of the permanent magnet and associated pole structure and project out the face of the magnetic structure opposite the face on which the armatures are located. Because the printing wires must be of a certain mimimum length to allow for curvature thereof to properly position their printing ends adjacent each other, running the wires back through the magnet structure permits the printer head nose, or wire end support portion, to be shortened to further reduce the size and weight of the head.

BRIEF DESCRIPTION OF THE DRAWINGS

The invention is hereafter described in greater detail by reference to the accompanying drawings wherein:

FIG. 4 is a sectional view through the centerline of a printer head illustrating another mode for carrying out the invention;

FIG. 5 is a rear elevational view of the printer head of FIG. 4 with portions broken away to show the components therein;

FIG. 6 is a perspective view of internal components of the printer head of FIG. 4;

BEST MODES FOR CARRYING OUT THE INVENTION

Figure 1:
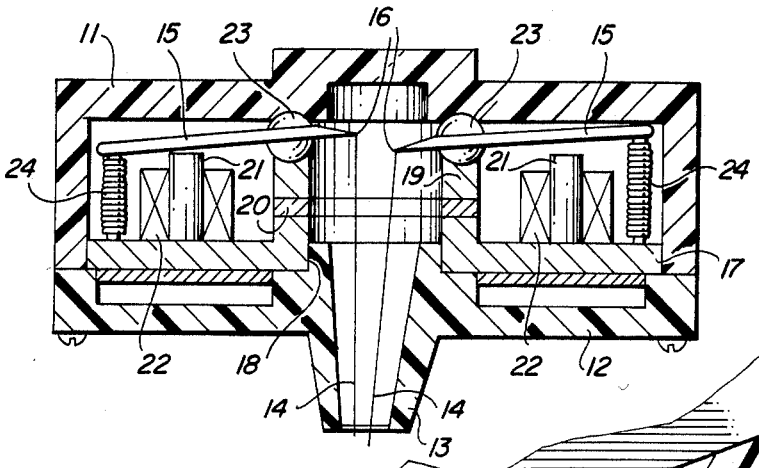
FIG. 1 is a sectional view through the centerline of a printer head embodying the invention.
Figure 3:
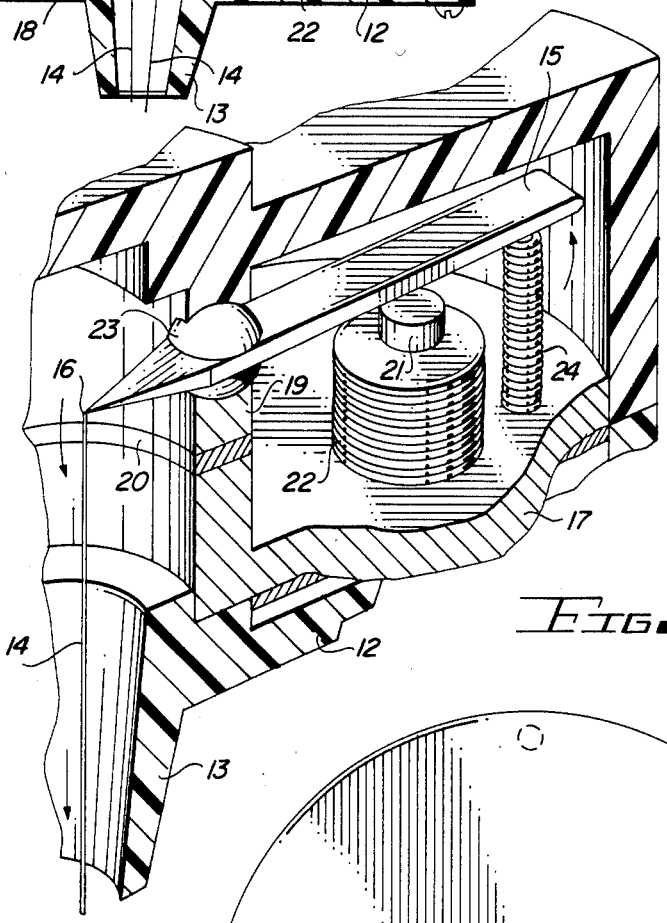
FIG. 3 is a perspective view of internal components of the printer head of FIG. 1.
Figure 2:
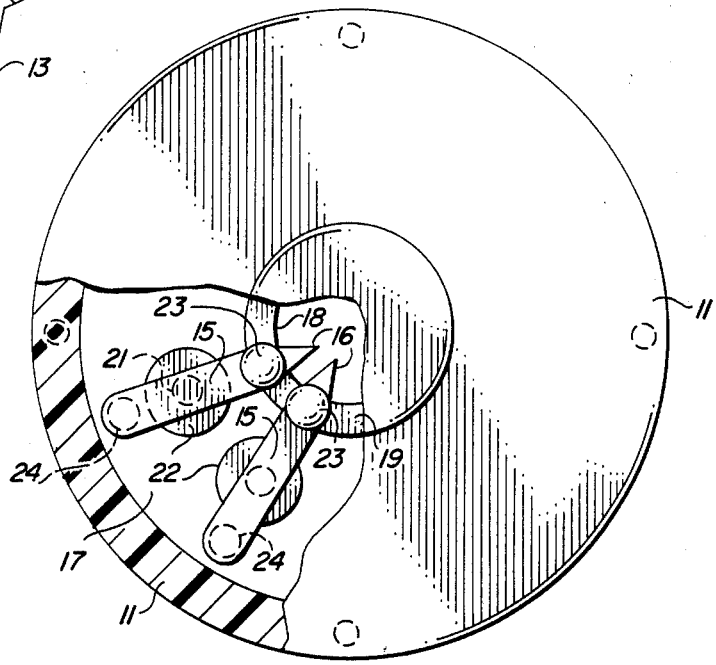
FIG. 2 is a rear elevational view of the printer head of FIG. 1, with portions broken away to show the components therein.

Referring particularily to FIGS. 1 to 3, the printer head there illustrated has an outer casing provided by a back cover 11 and an complementary front cover 12 which has a centrally located nose, or guide, portion 13 for guiding the printing ends of a plurality of printing wires 14 into contact with the print receiving surface (not shown). Printing wires 14 are actuated by a like number of aramatures 15. The aramatures 15 are radially disposed with respect to the centerline of the printer head and have their inner ends 16 secured to, or otherwise adapted to contact, proximate ends of printing wires 14.

The printer head includes magnetic and electromagnetic means for actuating armatures 15 to move printing wires 14 between print and non-print positions. This magnetic means comprises a core base member 17 having a central opening 18 therein. Core base member 17 is made of magnetically permeable material, such as soft iron, and has upstanding therefrom an annular yoke member 19 which is also made of magentically permeable material. Disposed within yoke member 19 is a permanent magnet 20. Magnet 20 is formed to a ring, or annular, shape from any of the well known permanent magnetic materials such as the rare earth metals. The magnetic circuit of the magnet means is completed by a plurality of upstanding electromagnet cores 21 which are arranged in a circular array surrounding, i.e. outside of, permanent magnet 20 and yoke member 19, There is one electromagnet core 21 for each armature and each core has a coil, or winding, 22 thereon.

Each armature 15 is mounted for pivotal movement within the printer head by a bearing 23 movably confined between back cover 11 and annular yoke member 19. Yoke member 19 serves as a fulcrum for all the armatures 15. If desired, lubricant containing means (not shown) may be provided for lubricating bearings 23 to provide for friction free movement of armatures 15.

When there is no electric current flowing through one of the electromagnet coils 22, permanent magnet 20 imparts a magnetic flux in yoke member 19, core base member 17 and the core 21 surrounded by the deenergized coil. This flux creates an attractive force acting on the armatures 15 associated with that particular core 21 with the result that the armature is drawn against its core and the printing wire 14 associated with that core is withdrawn into the head 13 to its non-print position. This condition for these elements is shown in the left hand portion of FIG. 1.

When a printing wire 14 is to be moved to its print position, i.e. the position illustrated in the right hand portion of FIG. 1, the coil 22 on the core 21 associated with the armature 15 for that wire is energized. The winding of coil 22 is such as to create a flux in its core 21 in opposition to the flux created therein by permanent magnet 20. This frees armature 15 of any magnetic attractive forces and enables the armature to be moved by biasing means in the form of a coiled compression spring 24. In the apparatus shown in FIG. 1 there is one spring 24 for each armature 15 and the springs are compresses between the outer ends of the armatures and a peripheral region of core base member 17.

One of the principal advantages of the printer head constructed in accordance with this invention is that the electromagnet coils 22 are positioned around and outside permanent magnet 20 and yoke member 19. Thus, there is a maximum amount of space available to house the coils. This facilitates their assembly and also simplifies dissipating heat from the coils which is generated by electric current flowing therethrough.

It is also to be noted that printing wires 14 extend from armatures 15 through the central opening 18 in core base member 17 and project out the face of member 17 opposite the face where the armatures are positioned. With this arrangement wires 14 can be made of sufficient length and flexibility to permit their printing ends to be properly aligned by nose portion 13 without nose portion 13 being required to be of excessive length. This arrangement contributes to the compactness and lightness of the printer head.

In the printer head component arrangement of FIGS. 1 to 3 each spring 24 and the magnetic forces from the magnet means acts on each armature 15 as a lever of the first class with yoke member 19 as the fulcrum. It can be appreciated that by selecting and adjusting the position of the fulcrum provided by yoke member 19 it is possible to adjust the amount of force transmitted to the print wires 14 by the armatures 15.

Another mode for carrying out this invention is illustrated in FIGS. 4 to 6 wherein like reference numerals are used to identify components whichh are common to this mode and the mode illustrated in FIGS. 1 to 3 and described above. The apparatus of FIGS. 4 to 6 operates in essentially the same manner as the apparatus of FIGS. 1 to 3, but the biasing means for the armatures 15 has been changed to compression springs 26 acting between the inner ends of armatures 15 and a central housing portion 27 of back cover 11. The advantage of this arrangement is that the outside diameter of the printer head can be further reduced because space outside coils 22 need not be provided for the springs.

Figure 7:
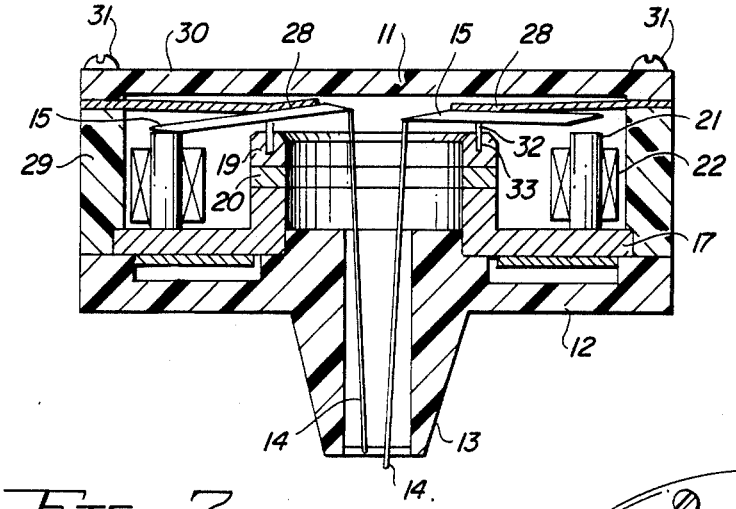
FIG. 7 is a sectional view through the centerline of another printer head illustrating a further mode for carrying out the invention.
Figure 8:
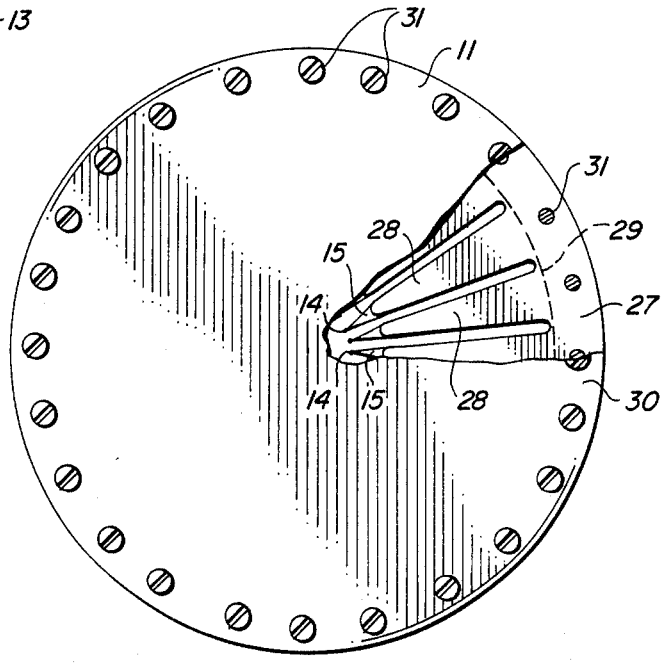
FIG. 8 is a rear elevational view of the printer head of FIG. 7, with portions broken away to show the components therein.
Figure 9:
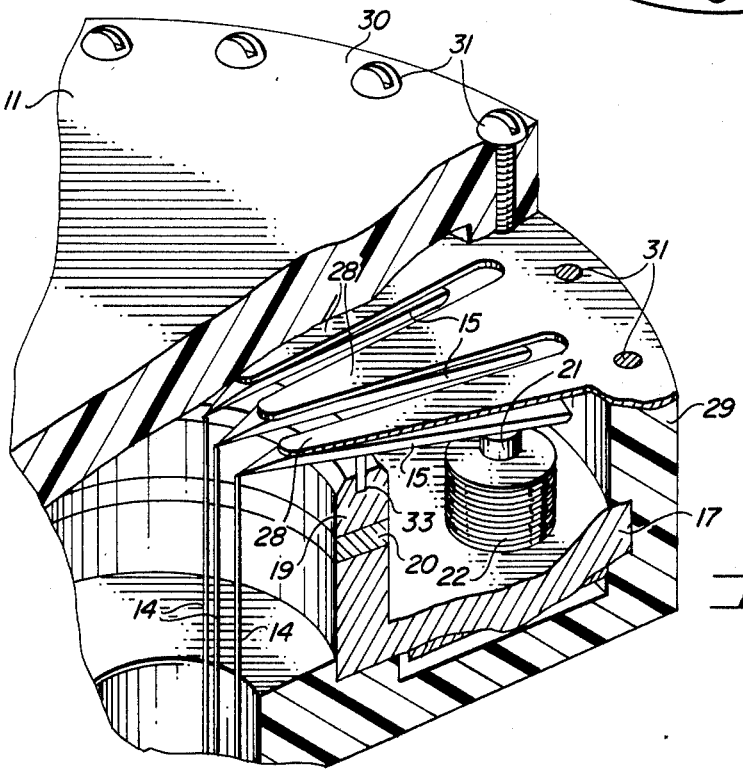
FIG. 9 is a perspective view of internal components of the printer head of FIG. 7.

A further mode for carrying out the invention and which results in an even more compact printer head is illustrated in FIGS. 7 to 9. In this arrangement the armatures 15 are biased to their print positions by a disc shaped spring member 27 having a plurality of radially extending leaves 28 positioned to have their free ends bearing on the inner ends of the armatures. This type of spring occupies very little space. For the purpose of mounting spring 27 the back cover 11 of the head can be divided into a housing ring 29 and a back plate 30. Housing ring 29 and back plate 30 can be held together with disc spring 27 clamped therebetween by screws, or other fastening means, 31.

Also illustrated in FIGS. 7 and 9 is an alternative fulcrum arrangement for the armatures 15. In this mode the bearings used in the previously described modes are replaced by leaf springs 32 attached to the armatures and positioned in a slot 33 in yoke member 19. Leaf springs 32 are effective to permit free pivoting movement of armatures 15 but prevent unwanted lateral movement of the armatures.

What is claimed is:

1. A dot matrix printer head comprising a plurality of printing wires, a like number of armatures adapted to control movement of said printing wires from a non-print position to a print position, and a magnetic means for selectively actuating said armatures, said magnetic means comprising an annular core base member of magnetically permeable material, a plurality of electromagnetic cores disposed in circular array on said base member, each of said cores being associated with a different armature and having an electrically energizable coil thereon, an annular yoke member carried by said base member within said array of cores, said yoke member being magnetically associated with and constituting a fulcrum for said armatures, and an annular permanent magnet disposed within said yoke member, said permanent magnet imparting a flux to said magnetic means for moving said armatures in one direction, said coils being selectively energizable to oppose the flux created by said permanent magnet in selected cores to permit the armature associated with a selected core to move in the opposite direction, said printing wires extending from said armatures through the open central regions of said yoke member, said permanent magnet and said base member.

2. A printer head as claimed in claim 1 further comprising cover means for holding said armatures on the fulcrum provided by said yoke member.

3. A printer head as claimed in claim 1 wherein said armatures are mounted on said yoke member by means of leaf spring members positioned in a slot in said yoke member.

4. A printer head as claimed in claim 2, wherein said armatures have bearings thereon which are movably confined between said cover and said yoke member.

5. A printer head as claimed in claim 4, wherein said bearings have spherical surfaces.

6. A printer head as claimed in claim 1, wherein said armatures have inner ends and outer ends and the inner ends of the armatures are associated with said wires and the outer ends of the armatures are associated with said cores and the fulcrum provided by said yoke member is closer to the inner ends of the armatures than to the outer ends of the armatures.

* * * * *